United States Patent [19]

Schweizer

[11] 4,351,304

[45] Sep. 28, 1982

[54] FUEL INJECTION VALVE

[75] Inventor: Kurt Schweizer, Ingersheim, Fed. Rep. of Germany

[73] Assignee: Robert Bosch GmbH, Stuttgart, Fed. Rep. of Germany

[21] Appl. No.: 248,750

[22] Filed: Mar. 30, 1981

[30] Foreign Application Priority Data

Apr. 3, 1980 [DE] Fed. Rep. of Germany ..... 3013086

[51] Int. Cl.[3] ..... F02M 51/00

[52] U.S. Cl. ..... 123/585; 123/472; 239/417.3; 239/424

[58] Field of Search ..... 123/585, 587, 472; 239/296, 417.3, 422, 424; 137/480

[56] References Cited

U.S. PATENT DOCUMENTS

| | | | |
|---|---|---|---|
| 3,050,262 | 8/1962 | Curtis | 239/424 X |
| 3,980,233 | 9/1976 | Simmons et al. | 239/424 X |
| 4,171,689 | 10/1979 | Eheim | 123/586 X |
| 4,216,753 | 8/1980 | Inoue et al. | 123/472 |
| 4,304,211 | 12/1981 | Tezuka et al. | 123/585 |

FOREIGN PATENT DOCUMENTS

| | | | |
|---|---|---|---|
| 55-37555 | 3/1980 | Japan | 123/585 |

*Primary Examiner*—William A. Cuchlinski, Jr.
*Attorney, Agent, or Firm*—Edwin E. Greigg

[57] ABSTRACT

A fuel injection valve which serves in low-pressure fuel systems to inject fuel into the intake tube of a mixture-compressing internal combustion engine having externally-supplied ignition. The fuel injection valve includes a fixed valve seat cooperating with a movable valve element. Downstream of the valve seat, the fuel to be injected proceeds by way of a nozzle into a mixture guidance conduit, which communicates in the immediate vicinity of the nozzle with an intake passage downstream of a throttle valve of the intake passage. Likewise discharging at the mouth of the mixture guidance conduit into the intake passage is an annular conduit surrounding the mixture guidance conduit. Preparation air or exhaust gas can be delivered by way of this annular conduit in such a way that it envelops the injected fuel on all sides. The end of the annular conduit discharging into the intake tube is embodied as a throttle restriction. The embodiment of the fuel injection valve according to the invention assures good preparation of the fuel to be injected, while simultaneously avoiding an undesired leaning down of the fuel-air mixture delivered to the engine.

4 Claims, 3 Drawing Figures

FUEL INJECTION VALVE

BACKGROUND OF THE INVENTION

The invention is directed to a fuel injection valve. A fuel injection valve is already known in which an envelopment of air is provided in the direct fuel ejection region; as a result, the pressure that prevails in this region is not only intake tube underpressure but rather a pressure between that of the air which has been supplied and the intake tube underpressure. The pressure drop which is available for the purpose of fuel metering is thereby reduced, and thus the quantity of fuel ejected is also reduced. This produces an undesired leaning down of the fuel-air mixture supplied to the internal combustion engine.

OBJECT AND SUMMARY OF THE INVENTION

An object of the invention is to provide a fuel injection valve which has advantages over the prior art wherein leaning down of the fuel-air mixture supplied to the engine is prevented.

As a result of the characteristics disclosed in the dependent claims, advantageous modifications of and improvements to the fuel injection valve disclosed in the main claim can be attained.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
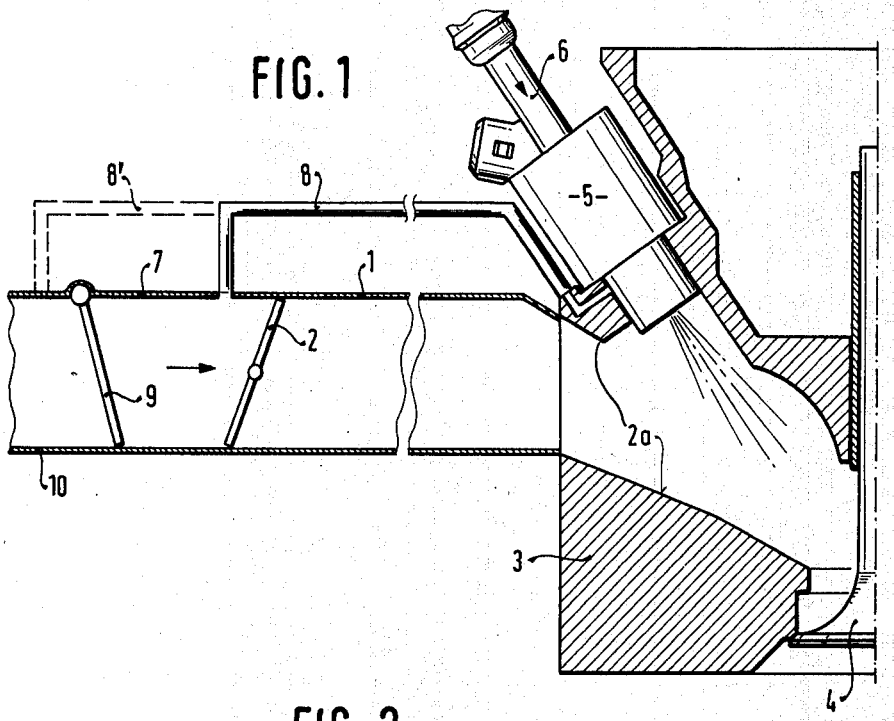
FIG. 1 shows the disposition on an internal combustion engine of a fuel injection valve according to the invention.
Figure 3:
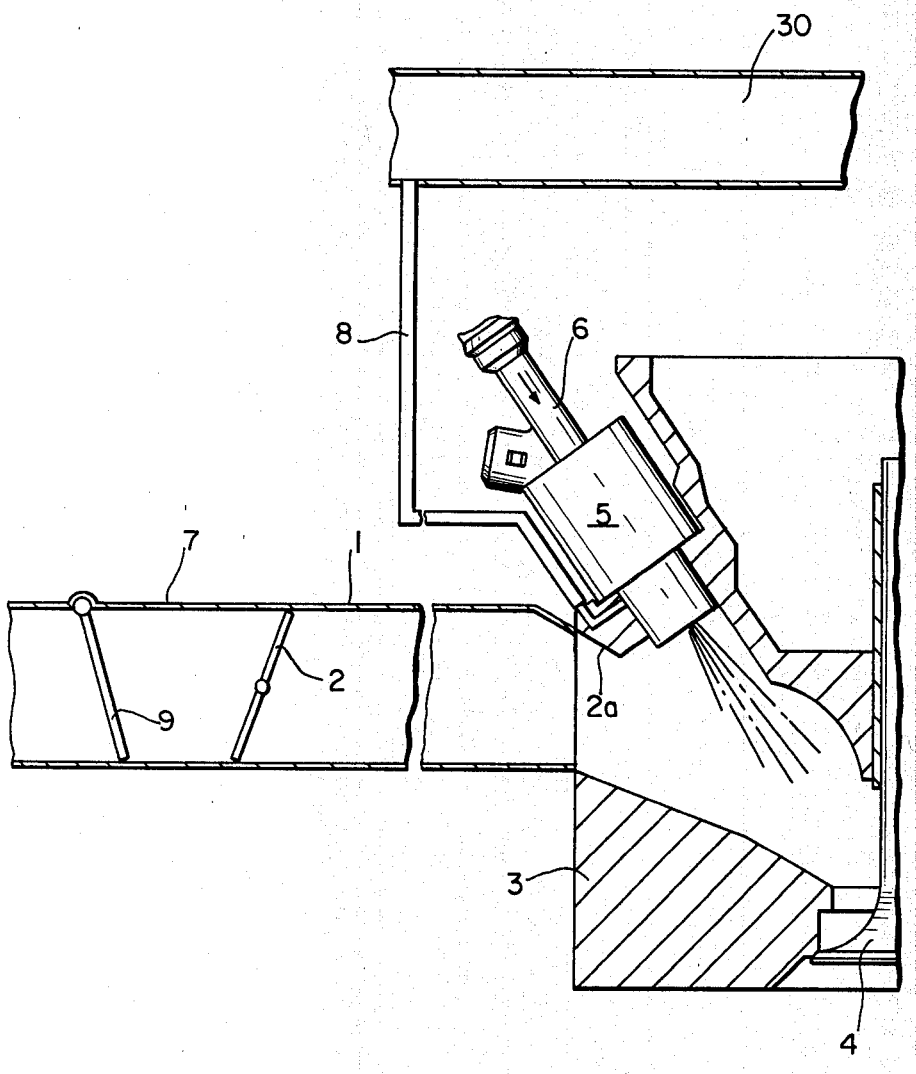
FIG. 3 illustrates a fuel injection valve in which the fluid line connected to the annular conduit communicates with the exhaust of the engine.

In FIG. 1, an intake tube section 1 is shown, having a throttle valve 2 serving as the throttle device disposed therein. The intake tube section 1 connects with and discharges into an intake passage 2*a* in a cylinder 3 of a mixture-compressing internal combustion engine having externally-supplied ignition. Admission of a fuel mixture from passage 2*a* into the cylinder 3 is controlled by an inlet valve 4 in the cylinder. Directly upstream of the inlet valve 4, there is a fuel injection valve 5 through which fuel can be injected into the intake passage in the immediate vicinity of the inlet valve 4, and specifically in the direction of the inlet valve 4. The fuel injection valve shown is, by way of example, an electromagnetically actuatable fuel injection valve which is triggerable in a known manner by means of an electronic control device, not shown, in accordance with engine operating characteristics. The fuel injection valve 5 communicates via an inlet stub 6 with a fuel supply line, not shown, which delivers fuel at relatively low pressure to the fuel injection valve. In low-pressure systems of this kind, good preparation of the fuel to be injected necessitates its atomization by means of air. The source of air may be compressed air, for example, or air drawn from the atmosphere, as shown herein. This atmospheric air is diverted upstream of the throttle valve 2 from an intake tube section 7, by way of example, and delivered to the fuel injection valve 5 via an air line 8. The intake tube section 7 is defined on one end by the throttle valve 2, and it may be defined on the other side by an air flow rate meter 9 embodied in a known manner as a baffle plate, whose position in the intake tube represents a standard for the quantity of air aspirated by the engine. The position of the flow rate meter 9 is converted into an electrical variable and fed into an electronic control device for the purpose of determining the fuel quantity injected by the fuel injection valve 5. As indicated by broken lines in the drawing, however, an air line 8′ may also branch off from an intake tube section 10 upstream of the air flow rate meter 9; this makes available a greater pressure drop down to the intake tube underpressure. The air line 8 could be connected instead, however, to the exhaust system 30 of the engine, which is shown in FIG. 3; then exhaust gas would serve the purpose of preparation of the fuel to be injected. This would also have the result that a sufficiently higher transport pressure would be available in the full-load range of the engine.

Figure 2:
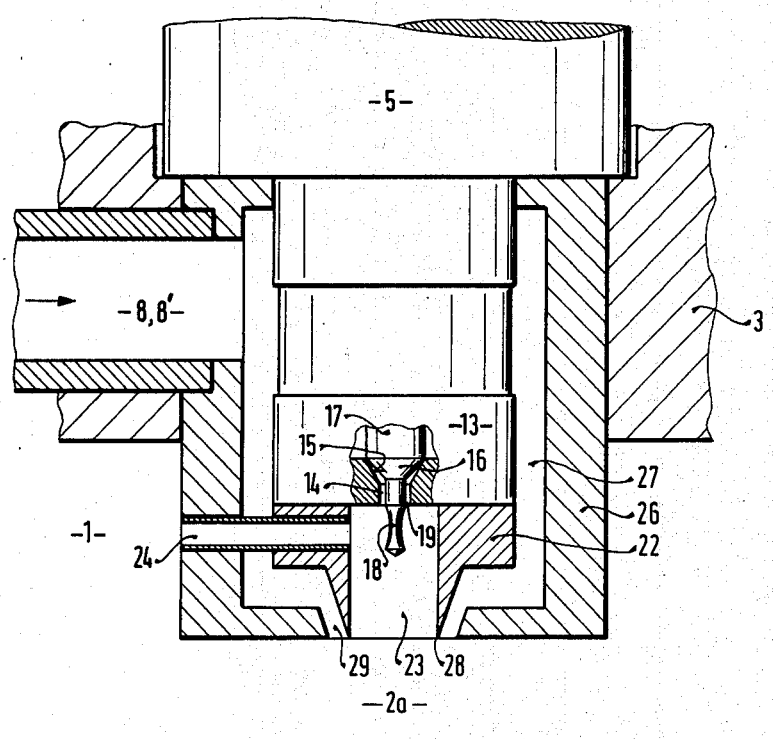
FIG. 2 is a detailed partial view of a fuel injection valve having air envelopment.

In the fuel injection valve 5 shown in part in FIG. 2, a nozzle body 13 having a nozzle 14 and a conically embodied fixed valve seat 15 is shown. An outer conical face 16 of an electromagnetically actuatable nozzle needle 17 cooperates with this fixed valve seat 15. A needle tang 18 adjoins the outer conical face 16 of the nozzle needle 17 and projects through the nozzle 14 in axial alignment with nozzle needle 17. The annular gap which exists between the needle tang 18 and the wall of the nozzle 14 serves as a metering cross section 19, because it is embodied as a throttle restriction with substantial resistance, it accordingly determines the quantity of fuel ejected in a unit of time, because of the prevailing pressure drop, and also determines the duration in time of the electrical opening pulses, with which the nozzle needle 17 is raised from its valve seat 15. A mixture guidance body 22 is disposed directly adjacent to the nozzle body 13, and a mixture guidance conduit 23 opening toward the intake passage 2*a* is embodied within the mixture guide body 22 concentric to the needle tang 18. The ejected fuel thus first proceeds directly downstream of the nozzle 14 into the mixture guidance conduit 23, which communicates as close as possible to the nozzle 14 and with the intake passage downstream of the throttle valve 2, via an underpressure conduit 24. It is thereby assured that it is always the intake tube underpressure which prevails at the side of the nozzle 14 oriented toward the intake tube, and the greatest possible pressure drop is thus available for metering purposes.

The nozzle body 13 of the fuel injection valve 5 may be surrounded by an air guidance sheath 26; an annular conduit 27 is disposed in this air guidance sheath 26 and is defined on the other side by the nozzle body 13 and the mixture guidance body 22. The annular conduit 27 communicates via the air line 8 or 8′, respectively, with the intake tube section 7 or 10, respectively, or with the exhaust system of the engine. The end 29 of the annular conduit 27 is likewise provided in the vicinity of the mouth 28 of the mixture guidance conduit 23 into the intake tube. As a result, the fuel exiting from the mixture guidance conduit 23 is enveloped on all sides by air or exhaust gas and is thus prepared. The end 29 of the annular conduit 27 is embodied as a throttle restriction, so that the full pressure drop down to the intake tube pressure is available at that location, and the maximum differential velocity between the preparation air and the fuel can be utilized for preparation purposes. At the same time, the air throughput is determind by the throttle restriction 29.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. A fuel injection valve wherein preparation of a fuel injected into a intake passage in a cylinder of an internal combustion engine downstream of a throttle device is effected by a gaseous medium, in which said fuel injection valve includes a nozzle valve that injects fuel when the nozzle valve is opened, a mixture guidance conduit relative to said nozzle valve into which fuel is injected, said guidance conduit including a mouth, an intake tube connected with said mixture guidance conduit at a position directly opposite that at which fuel is injected, a throttle valve upstream of said intake tube connection with said mixture guidance conduit and an annular conduit surrounding said mixture guidance conduit, a fluid line connected at one end to said annular conduit, said annular conduit including an end opening through which fluid from said fluid line discharges into said intake passage whereby fluid admitted through said conduit surrounds the injected fuel discharged from said mixture guidance conduit.

2. A fuel injection valve as defined by claim 1, wherein the end of the annular conduit discharging into said intake passage is embodied as a throttle restriction.

3. A fuel injection valve as defined by claim 2, wherein said fluid line connected at one end to said annular conduit communicates with the intake tube upstream of the throttle device.

4. A fuel injection valve as defined by claim 2, wherein said fluid line connected at one end to said annular conduit communicates with the exhaust of said engine.

* * * * *